United States Patent [19]

Cynamon

[11] 3,966,202

[45] June 29, 1976

[54] SWIMMING APPARATUS

[76] Inventor: Sam Cynamon, 4011 Kings Highway, Brooklyn, N.Y. 11234

[22] Filed: Aug. 12, 1975

[21] Appl. No.: 603,936

[52] U.S. Cl. ..... 272/71; 35/29 B; 272/85

[51] Int. Cl.[2] ..... A63B 31/00

[58] Field of Search ..... 35/29 B, 29 C, 29 D, 35/29 E; 272/24, 61, 71, 85

[56] References Cited

UNITED STATES PATENTS

| | | | |
|---|---|---|---|
| 206,892 | 8/1878 | Monstery | 272/71 |
| 793,288 | 6/1905 | Faber | 35/29 B X |
| 994,567 | 6/1911 | Berzac | 272/24 |
| 3,058,744 | 10/1962 | McGuire | 272/85 |
| 3,130,969 | 4/1964 | Groth | 272/85 |
| 3,476,385 | 11/1969 | Foy | 272/24 |

FOREIGN PATENTS OR APPLICATIONS

| | | | |
|---|---|---|---|
| 1,255,733 | 1/1961 | France | 272/85 |

*Primary Examiner*—Harland S. Skogquist
*Attorney, Agent, or Firm*—Edith Grill

[57] ABSTRACT

A portable, collapsible apparatus to teach swimming both on land or in the water, having a stationary tripod support means provided with hand grips, and a torso support means adjustably suspended from said tripod in a horizontally balanced position, to allow for freedom of head, leg, and arm movements.

10 Claims, 7 Drawing Figures

SWIMMING APPARATUS

This invention relates to a device designed for use in teaching swimming, as well as being useful in water therapy. It can also be used for exercising and endurance testing. The versatility and simplicity of design make the apparatus particularly useful in the fields of swimming instruction and rehabilitation via water therapy and exercising.

Accordingly, instant invention relates to an apparatus used in the instruction and learning of swimming movements and capable of being used both on land and in the water, comprising a stationary tripod support means containing upwardly converging leg members, interconnecting means at their upper ends to limit the divergent movement of said leg members, and having a suspension support means; a freely-swinging, horizontally-balanced torso support means adjustably suspended from said suspension means comprising an open-ended, flexible sling for receiving the user in a prone position, and a sling support balancing means connected to said sling by means of flexible cable and at a sufficient height from said sling to permit unimpeded freedom of swimming motion.

A principal object of instant invention is to provide an improved apparatus which may be effectively employed in the instruction of the proper swimming movements with a maximum amount of freedom of the pupil's head, torso, legs and arms.

Another object of instant invention is to provide an apparatus adjustable to supporting different physical characteristics of various users.

Still another object is to provide a stationary, horizontally balanced support for the pupil in order to impart a sense of security and eliminate fear of the water.

Another object is the provision of an adequate support for the handicapped during water therapy, thereby freeing the hands of the therapist for appropriate manipulative procedures.

Still another object is to provide a readily portable, collapsible apparatus, for easy transportation and storage and economical to manufacture.

In accordance with the above objects and such other objects and features which will become apparent from the following specification, the invention will be understood from the accompanying drawings, wherein like characters designate like parts and wherein.

Figure 1:
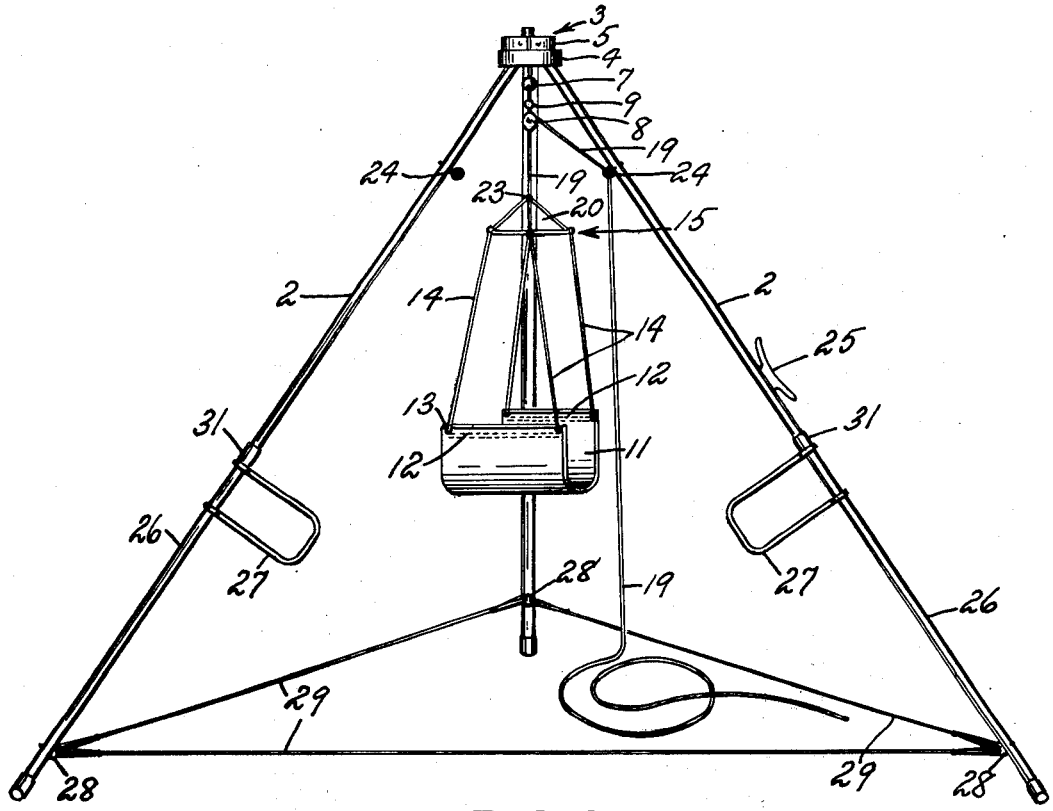
FIG. 1 is a perspective view of the swimming apparatus of instant invention.

Referring to the drawings in detail, the swimming apparatus of the invention comprises a tripod support means 1 which may conveniently be made out of tubular stock such as tempered steel, heavy aluminum, or other hard, strong material containing three converging leg members 2, interconnected at their upper ends by a tripod head 3 which limits the divergent movement of leg members 2 and includes a collar member 4 and three oval-shaped guide members 5 to which legs 2 are secured by any suitable means such as bolts 6 or rivets or the like.

Guide members 5 serve the dual function of limiting the divergent movement of leg members 2 and also provide additional strength to the tripod support mechanism. Although oval guide means are shown, other shapes may be substituted therefor; said guide means preferably being an integral part of the tripod head.

Tripod head 3 is additionally provided with a suspension support means 7 such as an eyehook permanently secured through the center thereof to which one or more pulleys 8 may be removably attached by means of an S-hook 9 or permanently attached by means of eyebolt 7.

Suspended from pulley 8 is a freely swinging torso support means 10 comprising an open-ended, flexible sling 11 which may suitably be made out of canvas or other porous, non-stretchable material having limited resiliency for comfort to the user but capable of retaining its shape after repeated wetting and drying and in a suitable size and shape to afford maximum freedom to arm and leg motions as well as support the body comfortably. It has been found that the proper size to support the pupil comfortably extends from the chest to mid-thigh and is preferably rectangular in shape, with or without a cut-out at the crotch area. It is preferable that the sling does not completely embrace the torso. A half-inch layer of foam may be inserted within the canvas casing to provide additional comfort with a minimum amount of buoyancy. Sling 11 is provided with a pair of rigid rods 12 at opposite ends in order to maintain the shape of sling 11, and four eyelet openings 13, one at each corner thereof.

Flexible cable 14 which may be made out of rope material, nylon or other desirable material is threaded through eyelets 13 and secured to circular openings 17 situated at the free ends of intersecting bars 16 of sling support balancing means 15 by means of U-bolts 18 or by other suitable clamping means. The rope may be interwoven in such a fashion as to eliminate the U-bolt clamping means. The major function of sling support 15 is to maintain sling 11 in a balanced horizontal plane.

Pulley cable 19 which is made out of the same type of material as cable 14, is threaded through openings 17 of sling support 15 in such a manner as to form rectangularly-based pyramid 20, its apex 23 being centered longitudinally above the point of intersection 21 of the intersecting bars 16 of sling support 15, apex 23 of pyramid 20 being secured by clamping means 22 or interweaving. The formation of a pyramid with the pulley cable 19 enhances the horizontal balance afforded by sling support 15 to sling 11. Pulley cable 19 extends from apex 23 of pyramid 20 over pulley 8 through guiding means 24, such as an eyebolt attached to tripod leg member 2 and is terminally secured to same leg member 2 by means of a reel or cleat 25 mounted thereon.

The torso support means 10 can be adjusted to any desired height by manipulating pulley cable 19, thereby enabling an instructor to accommodate the various needs, desires and sizes of his students as well as adjust to both land and water conditions of instruction.

All tripod leg members 2 may be provided with guiding means 24 in the form of eyebolts or the like for threading cable to sling support 15 to afford additional stability and a greater sense of security to the fearful student.

In order to make this apparatus readily portable and collapsible, it is desirable to have three leg extensions 26 which can be secured to tripod leg members 2 by any suitable means, such as telescoping tubular sections as shown by 31 in FIG. 1, and fastening with a set screw or pin, or by a sleeve type connection, or by other joining or coupling means. Leg extensions 26 increase the height to the tripod support mechanism as needed, in a simple manner. Secured to the upper portion of any two extension legs 26 are hand grips 27 to afford a sense of security to the non-swimmer or learner. Although hand grips 27 are illustrated as rectangular in shape, rounded grips may also be used.

Hand grips 27 may alternately be secured to tripod leg members 2 in lieu of leg extensions 26 as preferred.

The bottom portion of each leg extension 26 is provided with a fastening means such as eyebolts 28 which engages leg anchors or leg braces 29 to prevent spreading and slipping of the tripod legs, eliminates vibration and provides additional stability to the swimming apparatus, as well as assists in maintaining the apparatus in a stationary position. Leg braces may alternately be attached to the bottom of tripod leg members 2. When disassembling this apparatus, leg braces 29, which may be steel cable covered by latex tubing, is disengaged from fastening means 28 by simply unfastening snap shackles 30 attached to the end portions of leg braces 29, said braces being rigid or flexible, depending on conditions of usage.

Any exposed screws may be covered by cap nuts, both for appearance and for greater safety to users of this equipment.

Figure 5:
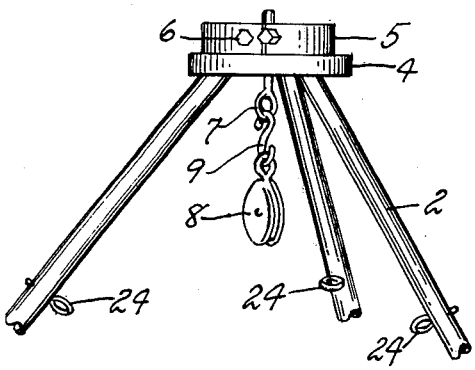
FIG. 5 is a fragmentary view of the upper portion of the tripod showing the suspension means for the torso support means.
Figure 6:
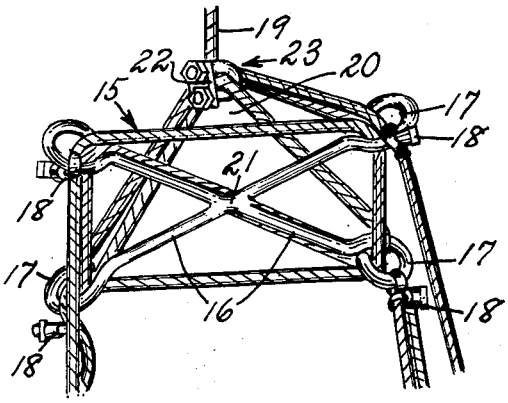
FIG. 6 is an enlarged fragmentary view of the upper portion of the torso support means, i.e., the horizontal balancing means.
Figure 7:
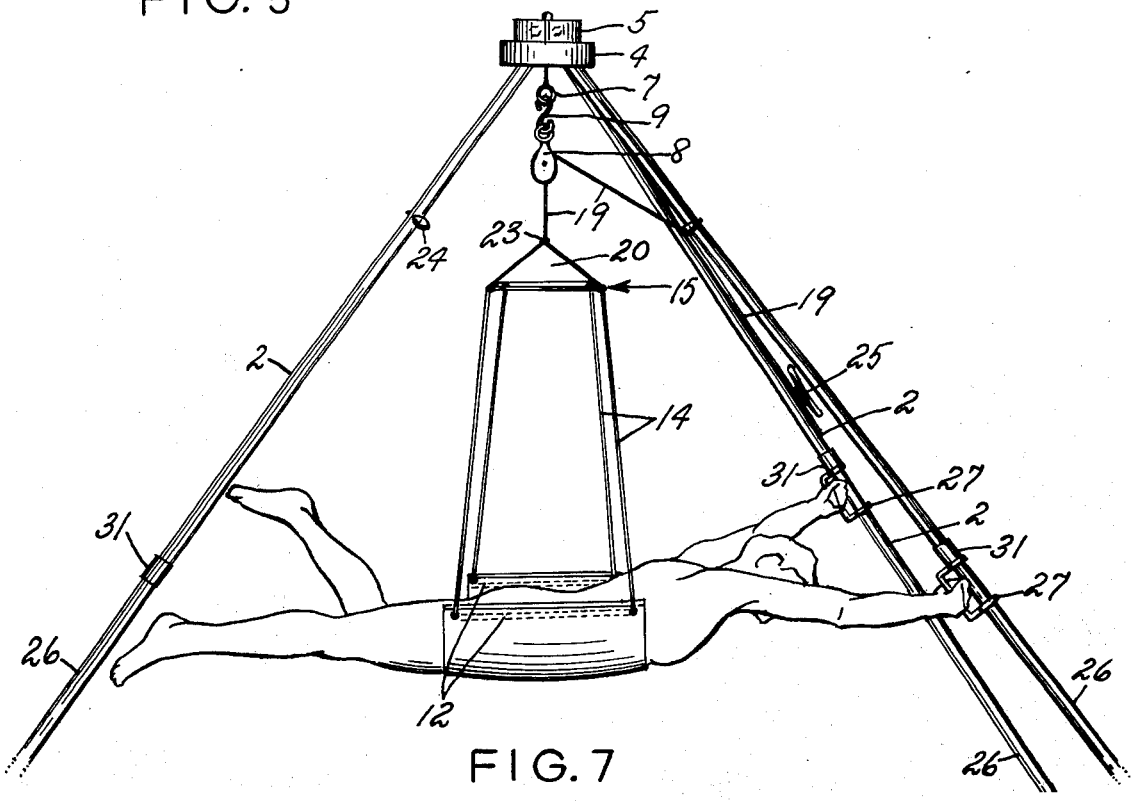
FIG. 7 is a perspective fragmentary view of the swimming apparatus showing a pupil supported therein.

In lieu of the single pulley 8 defined in FIG. 5, a system of pulleys and ropes, known as "block and tackle" can be used to lower or raise the student in the sling. Said "block and tackle" may consist of a lower block containing two pulleys and an upper block containing two pulleys interconnected by pulley cable 19 from one of the bottom pulleys to one of the top pulleys, and then down again to the other bottom pulley and up again to the other top pulley which is then threaded through guiding means 24 on leg member 2 and is fastened to fastening means 25 on same leg member 2.

Figure 2:
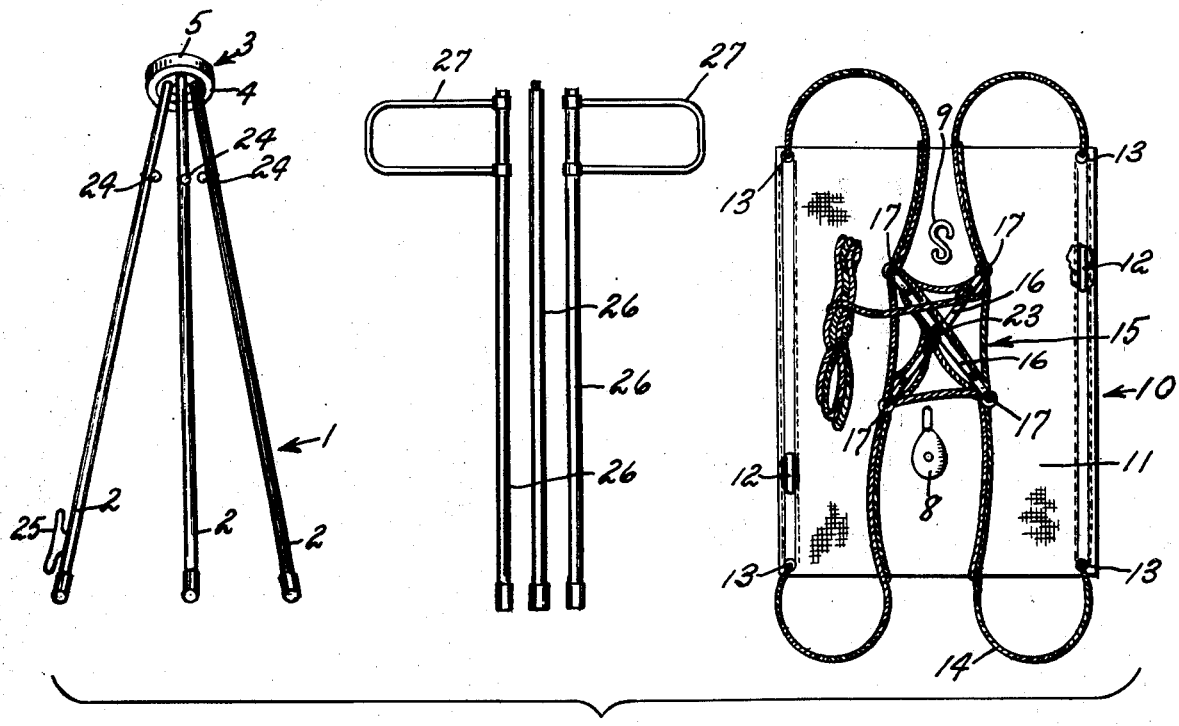
FIG. 2 is a perspective view of the swimming apparatus in collapsed condition, comprising a tripod support means; leg extenders with and without hand grips; and a torso support means.
Figure 3:
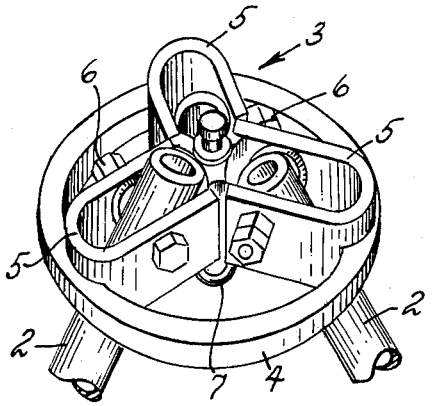
FIG. 3 is a top perspective fragmentary view of the head of the tripod support mechanism.
Figure 4:
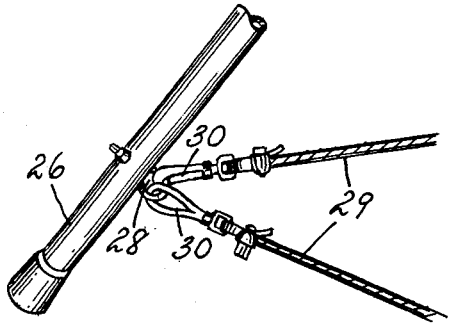
FIG. 4 is a fragmentary view of the leg anchors used for bracing the legs of the tripod.

As shown in FIG. 2, instant swimming apparatus is adapted to readily and simply be disassembled into tripod support means 1, leg extensions 26 optionally used to increase the height of the tripod, and horizontally balanced torso support means 10. Pulley 8 may be removable as shown or permanently affixed to suspension means 7 of tripod support means 1. It is readily portable in its compact form.

Although this invention has been described with reference to specific embodiments, it will be apparent to one skilled in the art that various modifications and equivalents may be made thereto which fall within the scope herein.

I claim:

1. An apparatus used in the instruction and learning of swimming movements and capable of being used both on land and in the water, comprising a stationary tripod support means containing upwardly converging leg members, interconnecting means at their upper ends to limit the divergent movement of said leg members and having a suspension support means; a freely-swinging horizontally balanced torso support means adjustably suspended from said suspension means comprising an open ended flexible sling for receiving the user in a prone position, and a sling support balancing means connected to said sling by means of flexible cable and at a sufficient height from said sling to permit unimpeded freedom of swimming motion.

2. The swimming apparatus in accordance with claim 1, wherein the leg members of said tripod support means is provided with hand grips.

3. The apparatus of claim 1, wherein the tripod support means is provided with individual leg extensions to increase the height of said tripod.

4. The apparatus of claim 1, wherein the size of the sling support is such as to extend from the chest to the mid-thigh of the user.

5. The apparatus of claim 1, wherein said sling is rectangular and said sling support balancing means comprises two intersecting bars attached at their free ends to the four corners of said rectangular sling.

6. The apparatus of claim 1, wherein the tripod legs are additionally provided with leg braces interconnecting at the bottom of the leg members.

7. The apparatus of claim 1, which is adapted to be disassembled into its compact form comprising the tripod support means and the horizontally balanced torso support means.

8. The apparatus of claim 1, wherein the freely swinging torso support means is adjustably suspended by means of at least one pulley system.

9. The apparatus of claim 8, wherein the pulley cable is secured to the sling support balancing means and forms a rectangularly-based pyramid therewith to enhance the horizontal balancing of the open-ended sling.

10. The apparatus of claim 9, wherein the pulley cable extends from the apex of the pyramid through a guiding means attached to a tripod leg member, and is terminally secured to same leg member.

* * * * *